US009028192B2

(12) United States Patent
Wahls

(10) Patent No.: US 9,028,192 B2
(45) Date of Patent: May 12, 2015

(54) LIFT ASSEMBLY

(76) Inventor: Stephen L. Wahls, Loomis, NE (US)

( * ) Notice: Subject to any disclaimer, the term of this patent is extended or adjusted under 35 U.S.C. 154(b) by 376 days.

(21) Appl. No.: 13/096,339

(22) Filed: Apr. 28, 2011

(65) Prior Publication Data

US 2011/0268542 A1 Nov. 3, 2011

Related U.S. Application Data

(60) Provisional application No. 61/329,234, filed on Apr. 29, 2010.

(51) Int. Cl.

| | |
|---|---|
| ***B65F 3/02*** | (2006.01) |
| ***B65F 1/14*** | (2006.01) |
| ***B65F 3/08*** | (2006.01) |
| *B65F 3/04* | (2006.01) |

(52) U.S. Cl.

CPC ..... *B65F 1/1452* (2013.01); *B65F 3/043* (2013.01); *B65F 3/046* (2013.01); *B65F 3/08* (2013.01)

(58) Field of Classification Search

CPC ..... B65F 3/046; B65F 3/043; B65F 3/041; B65F 3/04; B65F 3/08; B65F 1/1452; B65F 2003/023; B65F 2003/025; B65F 2003/0266; B65F 2003/0269; B65F 2003/0275; B65F 2003/0273; B65F 2003/0276; B65F 2003/0293; B65F 2003/0296; B65F 2003/0279; B65G 17/16; B65G 41/005; B65G 47/38

USPC ..... 414/332, 403, 404, 406, 408, 409, 419, 414/420, 425, 444, 445, 450, 467, 506, 539, 414/540, 541, 546, 547, 549, 556, 566, 569, 414/738, 739, 742, 743, 410, 595, 596, 598, 414/600; 298/1 B, 11

See application file for complete search history.

(56) References Cited

U.S. PATENT DOCUMENTS

| | | | | |
|---|---|---|---|---|
| 1,088,100 | A | 2/1914 | Saunders et al. | |
| 1,378,014 | A * | 5/1921 | Louis | 414/540 |
| 2,254,550 | A * | 9/1941 | Gladys | 414/413 |
| 2,399,698 | A * | 5/1946 | Gilbert | 414/596 |
| 2,573,584 | A | 10/1951 | Le Tourneau | |
| 2,715,471 | A * | 8/1955 | Asle | 414/598 |
| 3,083,849 | A | 4/1963 | Mottin | |
| 3,255,893 | A * | 6/1966 | Hainer et al. | 414/728 |
| 3,312,263 | A | 4/1967 | Wahlstrom | |
| 3,452,891 | A * | 7/1969 | Pappas et al. | 414/409 |
| 3,520,428 | A * | 7/1970 | Puckett | 414/409 |
| 3,549,030 | A | 12/1970 | Coughran, Jr. et al. | |
| 3,613,602 | A * | 10/1971 | Forster et al. | 105/191 |

(Continued)

OTHER PUBLICATIONS

"Development of a Prototype Specialist Shuttle Vehicle for Chipped Woodfuel" Mar. 2002, DTI Sustainable Energy Programmes, Project Profile 048, DTI/PUB URN 02/672, 1 page.

*Primary Examiner* — Saul Rodriguez
*Assistant Examiner* — Glenn Myers
(74) *Attorney, Agent, or Firm* — McKee, Voorhees & Sease, P.L.C.

(57) ABSTRACT

A lift apparatus includes an elongated spine having a top portion and a bottom portion, a traveler operatively connected along the elongated spine for traveling up and down the elongated spine, a single linear actuator operatively connected to the traveler configured to move the traveler up and down the spine, an arm, and a single hinge operatively connected between the traveler and the arm allowing the arm to hinge outwardly and upwardly to a dump position when the traveler is proximate the top portion of the elongated spine.

18 Claims, 12 Drawing Sheets

(56) References Cited

U.S. PATENT DOCUMENTS

| | | | | | |
|---|---|---|---|---|---|
| 3,753,593 | A | | 8/1973 | Wells et al. | |
| 3,779,409 | A | | 12/1973 | Herpich et al. | |
| 4,034,880 | A | | 7/1977 | Frenette | |
| 4,124,185 | A | | 11/1978 | Preisinger | |
| 4,314,788 | A | | 2/1982 | Williams et al. | |
| 4,408,946 | A | * | 10/1983 | Haven et al. | 414/424 |
| 4,543,028 | A | * | 9/1985 | Bell et al. | 414/408 |
| 4,778,327 | A | * | 10/1988 | Tufenkian et al. | 414/541 |
| 4,917,796 | A | * | 4/1990 | Rudzinski | 210/159 |
| 4,986,716 | A | * | 1/1991 | Winter | 414/409 |
| 5,002,450 | A | * | 3/1991 | Naab | 414/303 |
| 5,049,026 | A | * | 9/1991 | Bingman et al. | 414/408 |
| 5,064,248 | A | * | 11/1991 | Tegtmeier | 298/11 |
| 5,265,940 | A | | 11/1993 | Ostermeyer | |
| 5,312,162 | A | | 5/1994 | Baebel | |
| 5,338,140 | A | | 8/1994 | Ekdahl et al. | |
| 5,391,039 | A | * | 2/1995 | Holtom | 414/408 |
| 5,408,756 | A | | 4/1995 | Wahls | |
| 5,445,398 | A | | 8/1995 | Pierce | |
| 5,505,576 | A | * | 4/1996 | Sizemore et al. | 414/409 |
| 5,573,365 | A | | 11/1996 | Michalski | |
| 5,702,225 | A | * | 12/1997 | Ghibaudo | 414/408 |
| 5,725,348 | A | * | 3/1998 | Drake | 414/408 |
| 5,735,663 | A | | 4/1998 | Zachhuber | |
| 6,071,058 | A | * | 6/2000 | Tetz et al. | 414/409 |
| 6,113,340 | A | * | 9/2000 | Zalal | 414/598 |
| 6,468,019 | B1 | | 10/2002 | Duval | |
| 6,474,928 | B1 | * | 11/2002 | Christenson | 414/408 |
| 6,474,929 | B1 | * | 11/2002 | Hartman | 414/422 |
| 6,491,489 | B1 | * | 12/2002 | Stragier | 414/409 |
| 6,824,223 | B2 | | 11/2004 | Davidovic | |
| 6,877,534 | B1 | | 4/2005 | Hendrickson, Jr. et al. | |
| 7,559,735 | B2 | * | 7/2009 | Pruteanu et al. | 414/409 |
| 2006/0153667 | A1 | * | 7/2006 | Pruteanu et al. | 414/408 |
| 2009/0266820 | A1 | | 10/2009 | Osburn | |

* cited by examiner

LIFT ASSEMBLY

CROSS-REFERENCE TO RELATED APPLICATIONS

This application claims priority under 35 U.S.C. §119(e) to provisional application Ser. No. 61/329,234 filed Apr. 29, 2010, herein incorporated by reference in its entirety.

FIELD OF THE INVENTION

The present invention relates to loading and unloading of materials, especially loading of materials on to dump trucks or other trucks, wagons, or the like without interfering with unloading.

BACKGROUND OF THE INVENTION

The present invention provides for a method and apparatus for the loading and unloading of materials. To assist in understanding the present invention, problems which may be addressed by the present invention are discussed in the context of loading particulate matter into a dump truck. The present invention, is not, however, limited to particulate matter as it may be used for loading other types of materials. Nor is the present invention to be limited to the use in dump trucks as the present invention may be used in conjunctions with other types of trucks, wagons, and the like.

Although dump trucks provide for convenient dumping of materials, loading them is another matter altogether. Typically some form of loader is used such as a tractor with a scoop loader, an end loader, or other device. Thus, filling the dump truck requires an additional piece of machinery or else significant manual labor if one chooses to fill the dump track manually.

U.S. patent application Ser. No. 12/255,137 filed Oct. 21, 2008, to Wahls and is directed towards a shuttle bin. Although such a bin may be used on a dump truck, such a shuttle bin would add to the width of the dump truck, creating a wide load. What is needed is a lift suitable for a dump truck and other types of trucks and wagons that allows material to be easily and conveniently loaded on to a truck and which folds to a minimum size to avoid obstruction during transport.

BRIEF SUMMARY OF THE INVENTION

It is therefore an object, feature, or advantage of the present invention to improve over the state of the art.

It is a further object, feature, or advantage of the present invention to provide an apparatus for loading and unloading materials to and from a bin or container.

It is a further object, feature, or advantage of the present invention to provide an apparatus for loading materials which has a minimum folded size and which will avoid obstructions during transport and not create a "wide load."

Yet a further object, feature, or advantage of the present invention is to provide an apparatus and method for loading materials which has a reduced number of linkages.

A still further object, feature, or advantage of the present invention is to provide an apparatus and method for loading materials which is stable during operation and transport.

Another object, feature, or advantage of the present invention is to provide an apparatus and method for loading materials which does not interfere with unloading.

One or more of these and/or other objects, features, and advantages will become apparent from the specification and claims that follow. No single embodiment need exhibit all or any of these objects, features, or advantages.

According to one aspect of the present invention a lift apparatus is provided. The lift apparatus includes an elongated spine having a top portion and a bottom portion. The lift apparatus further includes a traveler operatively connected along the elongated spine for traveling up and down the elongated spine. There is a single linear actuator operatively connected to the traveler configured to move the traveler up and down the spine. There is also an arm and a single hinge operatively connected between the traveler and the arm allowing the arm to hinge outwardly and upwardly to a dump position when the traveler is proximate the top portion of the elongated spine.

According to another aspect of the present invention, a lift apparatus is provided. The lift apparatus includes a bracket, a hinge mounted to the bracket, a subassembly comprising a support surface operatively connected to a support surface assembly, the subassembly secured to the hinge, and an actuator operatively connected between the bracket and the subassembly. The apparatus is configured such that as the hinge opens, orientation of the subassembly relative to the bracket changes until a dump position is reached.

According to another aspect of the present invention, a lift is provided which is suitable for easy loading and unloading into a dump truck or other vehicle. The lift has a minimal folded size which avoids creating obstructions when transported. This is accomplished using a cantilevered hinge that opens in a way so as to lift the load without coming into contact with a side of the vehicle. Thus, the lift has a reduced number of linkages.

DETAILED DESCRIPTION

Figure 1A:
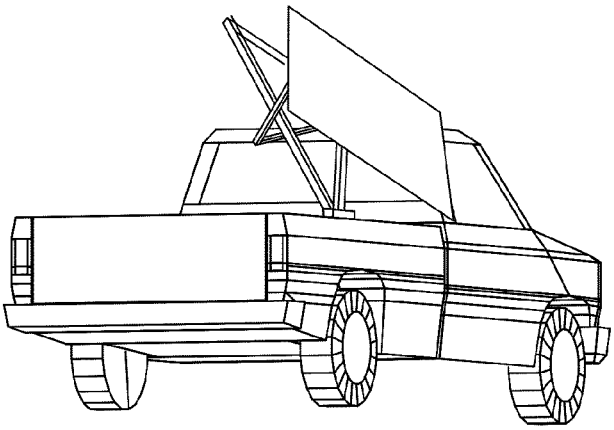
FIG. 1A to FIG. 1C are photographs of the lift attached to a truck and in various positions.
Figure 1B:
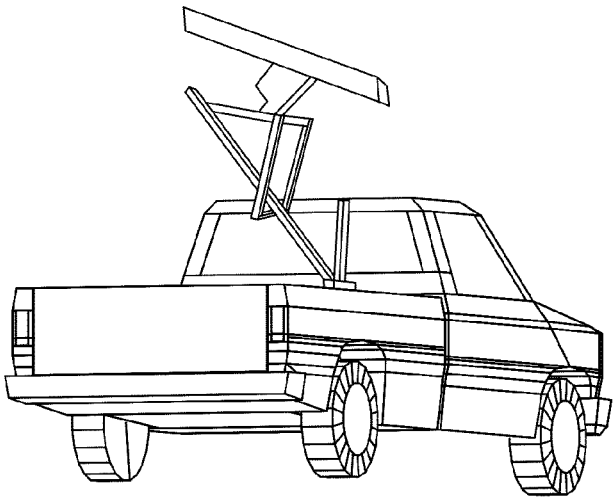
Figure 1C:
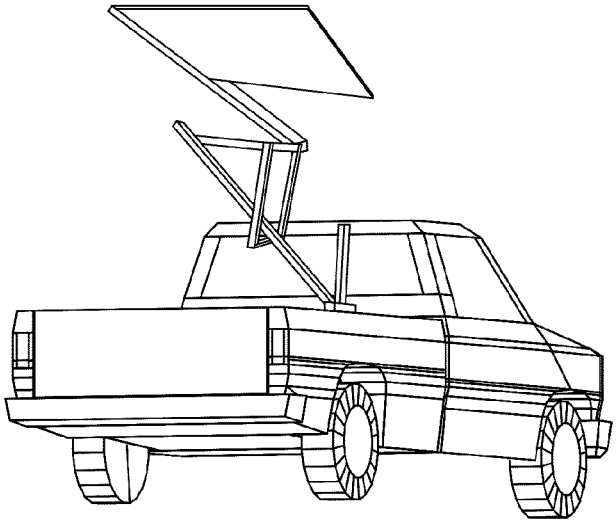

FIG. 1A through FIG. 1C provide photographs of the lift attached to a truck. Although a truck is shown, the lift may be attached to a dump truck, wagon, trailer or other vehicle (self-propelled or towed). The lift may be attached to the side of the truck. When the lift is in a folded position the lift does not interfere with normal operation of the truck. Thus, for example, when used in a dump truck, the dump truck can be dumped normally without the lift causing obstructions. The lift may be connected at the inside of a box of the truck. For example, the lift may be connected to the side or side and floor of the truck so that the lift does not add to the width of the truck. The lift allows for lifting loads into the truck. In operation, the lift would then hang over the side and not contact the side when folding up.

Figure 2:
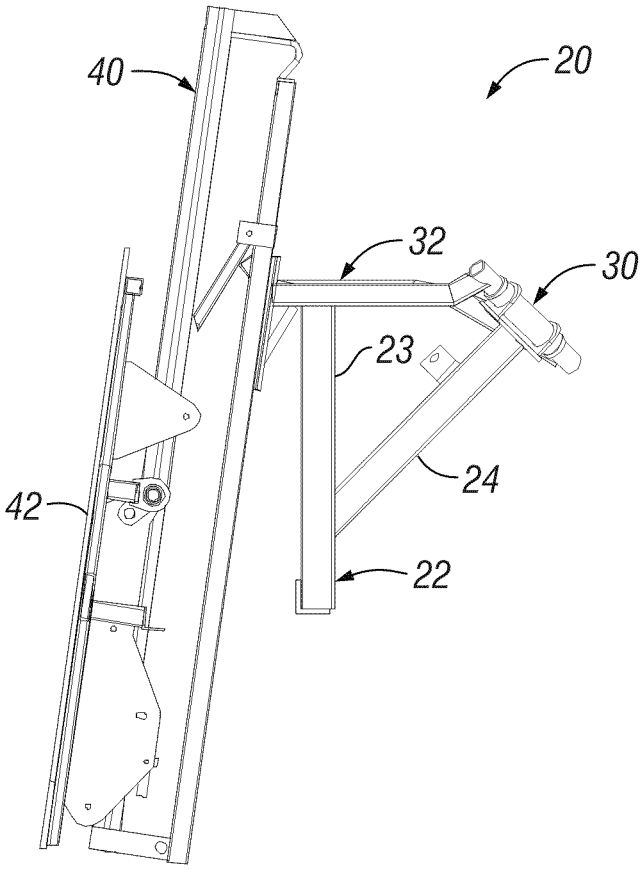
FIG. 2 illustrates the lift in a first position.
Figure 3:
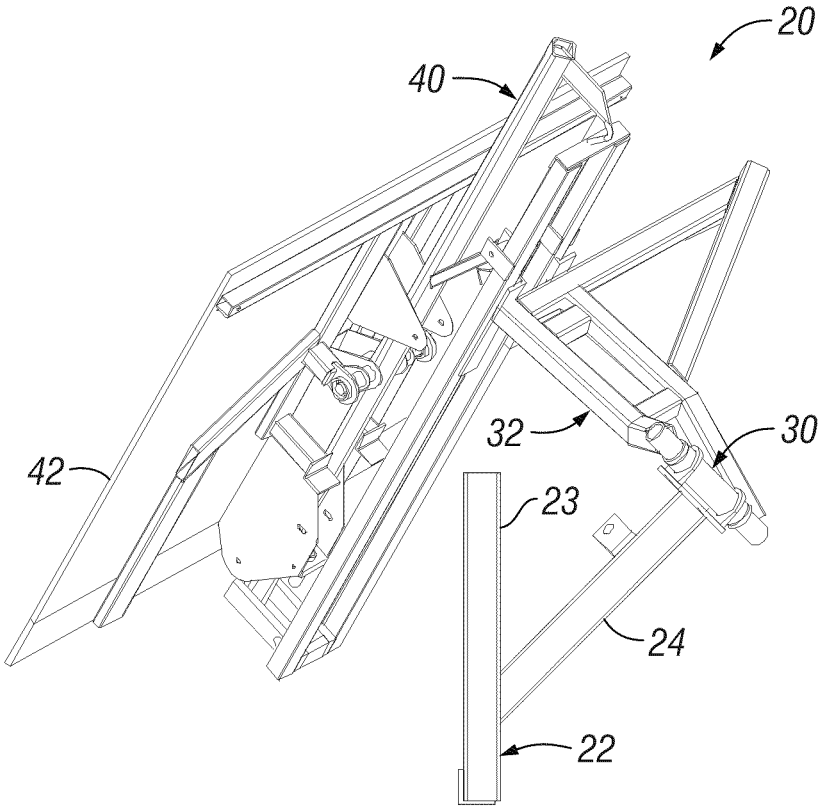
FIG. 3 illustrates the lift in a second position.
Figure 4:
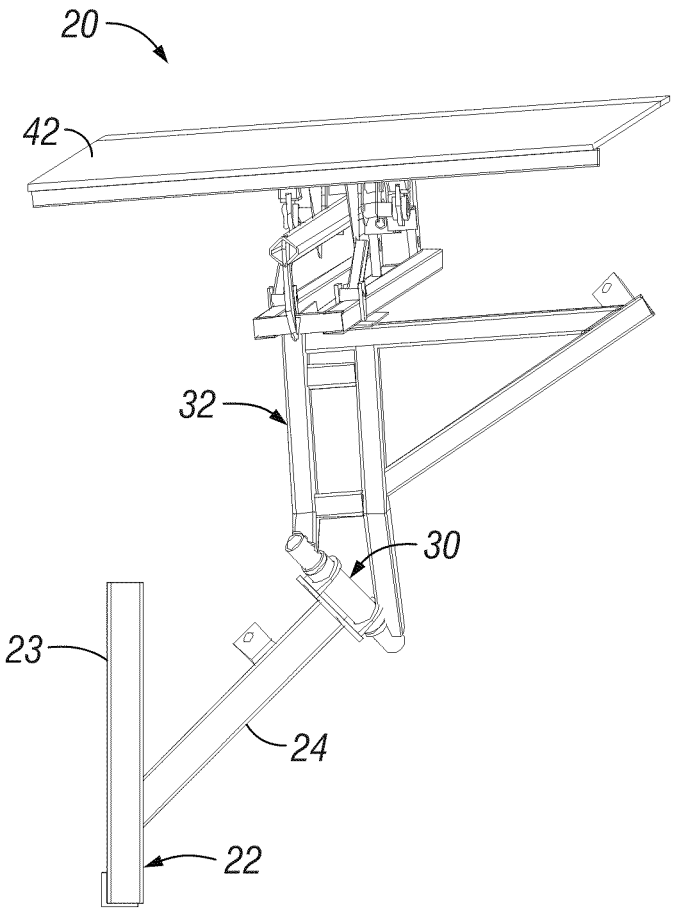
FIG. 4 illustrates the lift in a third position.

FIG. 2 illustrates the lift or loading, assembly 20. The lift 20 has a bracket 22 with a first arm 23 and a second arm 24. A hinge 30 is mounted between the second arm 24 of the bracket 22 and a subassembly 32. The subassembly 32 includes a support surface 42 which is operatively connected to a support surface assembly 40. A bin formed of a pliable material is operatively connected to the support surface 42.

In operation, a hydraulic actuator (not shown, but positioned between the attaching ears) provides for opening the hinge 30. As the hinge 30 opens, the orientation of the subassembly 32 relative to the bracket 22 changes until ultimately the lift 10 is moved to a dump position. Thus, in this way a single actuator (such as a single hydraulic cylinder) may be used to provide for lifting and dumping material. Another cylinder may be used in moving to and from a transport position. The hinge is a cantilevered hinge.

Figure 5:
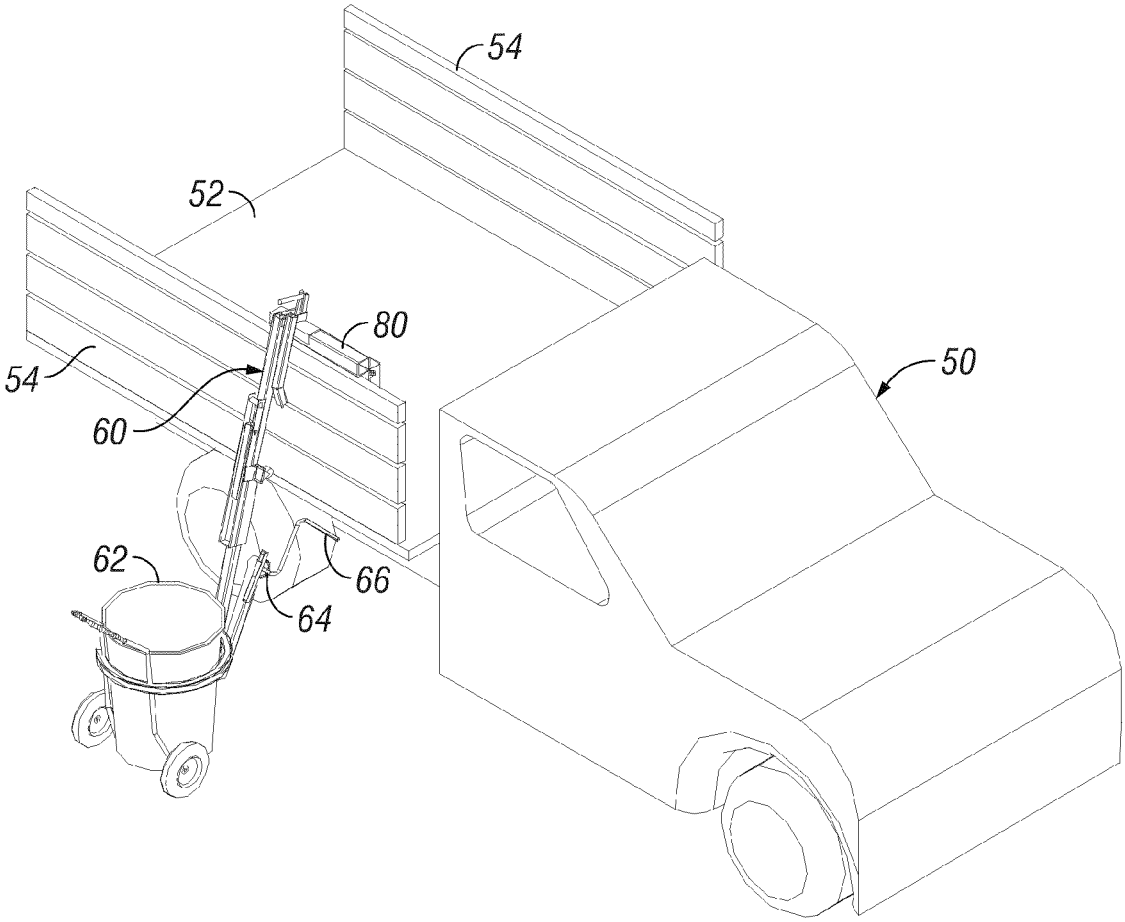
FIG. 5 illustrates another embodiment of the present invention where a lift is attached over the side of the truck.

Another embodiment of the lift is shown in FIG. 5 through FIG. 10. In FIG. 5, a truck 50 is shown with a truck bed 52 and side walls 54 and the lift 60 hangs over one of the sidewalls 54 of the truck 50. Is should be appreciated, however, that the truck 50 shown is merely one environment in which the lift 60 may be used. The lift 60 can be used with any number of trucks, wagons, carts, or other vehicles. Also shown in FIG. 5 is a container 62 connected to the lift 60 which may be dumped by the lift into the truck bed 52. The lift 60 shown has a winch 64 with a handle 66. Although other types of actuators may be used, use of the winch 64 allows an operator to raise and lower the lift in a convenient manner without requiring hydraulics, pneumatics, or electrical power. Also, instead of the container 62 other types of containers of any number of shapes and sizes may be used, or alternatively, a platform, basket or box or other structure may be attached (removeably or otherwise) to the lift instead. Also shown in FIG. 5 is arm 80. Arm 80 and the cantilevered hinge associated with arm 80 will be discussed in greater detail with respect to FIG. 11 through FIG. 16.

Figure 6:
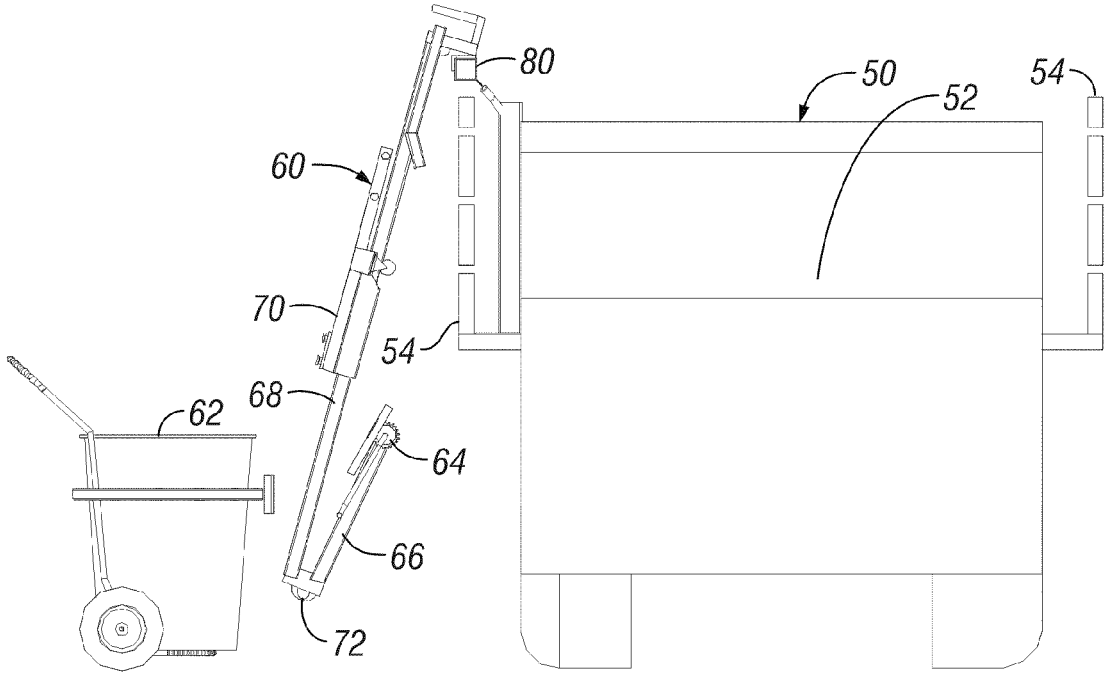
FIG. 6 illustrates the lift of FIG. 5 before a container is attached to the lift.

FIG. 6 illustrates the lift of FIG. 5 before a container 62 is attached to the lift 60. The lift 60 has an elongated spine 68. Along the spine 68 is a traveler 70 that travels up and down the spine 68. This movement of the traveler 70 may be imparted by a linear actuator in various ways. One such way is through use of a cable which forms a continuous loop. The cable (not shown) may wrap multiple times (although two is generally sufficient) around a drum associated with the winch 64, around a pulley 72, up through the spine 68 and down to the traveler 70. A spring may be on the traveler to apply tension. In addition, latches may be used such as at the hinge to allow the lift 60 to be locked down in an up position or a down position.

Instead of using a cable various other types of configurations may be used as a linear actuator to impart movement to the traveler 70. Examples may include hydraulic systems, pneumatic systems, or other types of systems such as a ball screw system. Also, although shown with a hand cranked winch, an electric winch may be used instead. Where an electric winch is used a battery may also be provided with the lift so that the lift need not be connected to a vehicle electrical system.

Figure 7:
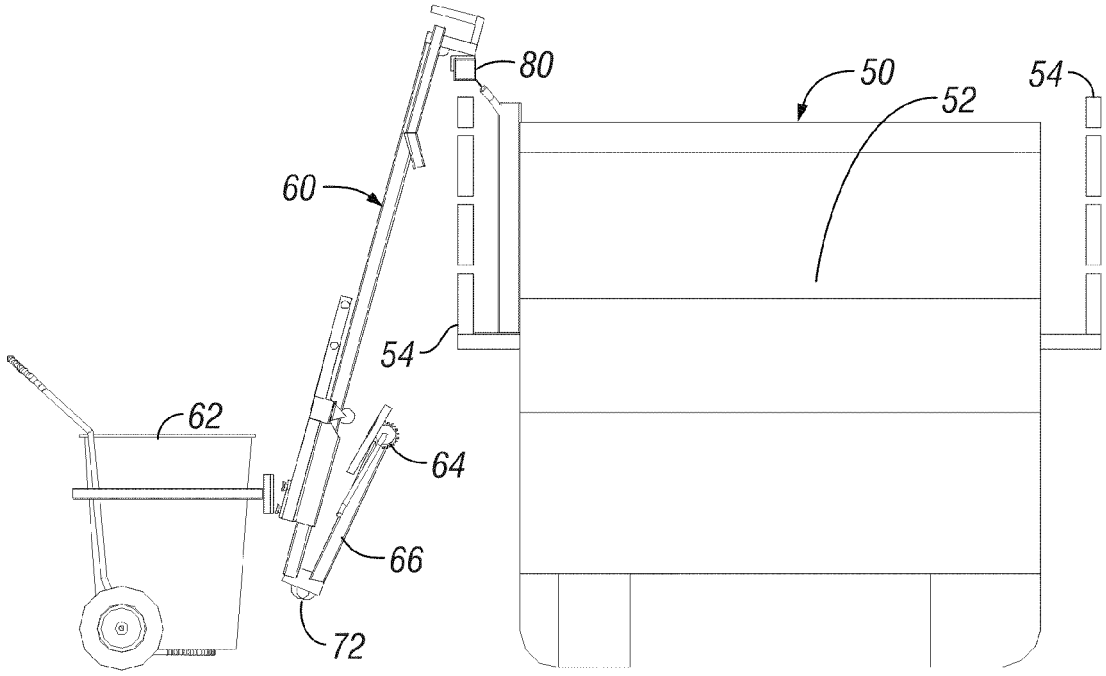
FIG. 7 illustrates the lift of FIG. 5-6 as the container is attached to the lift.
Figure 8:
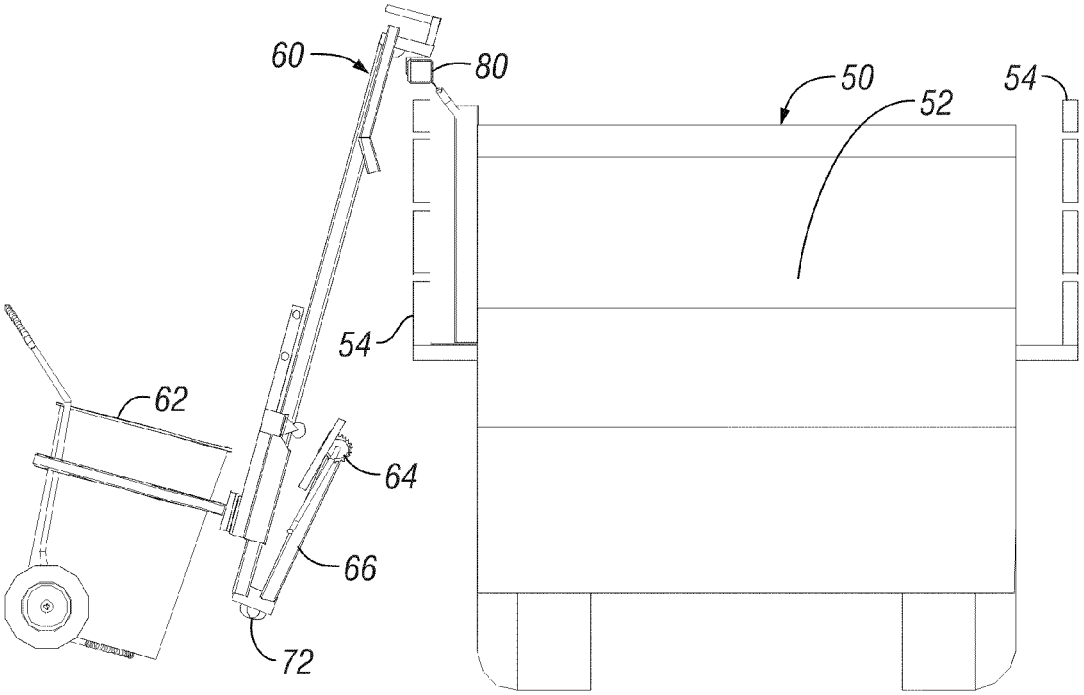
FIG. 8 illustrates the lift of FIG. 5-7 as the lift begins to lift the container.
Figure 9:
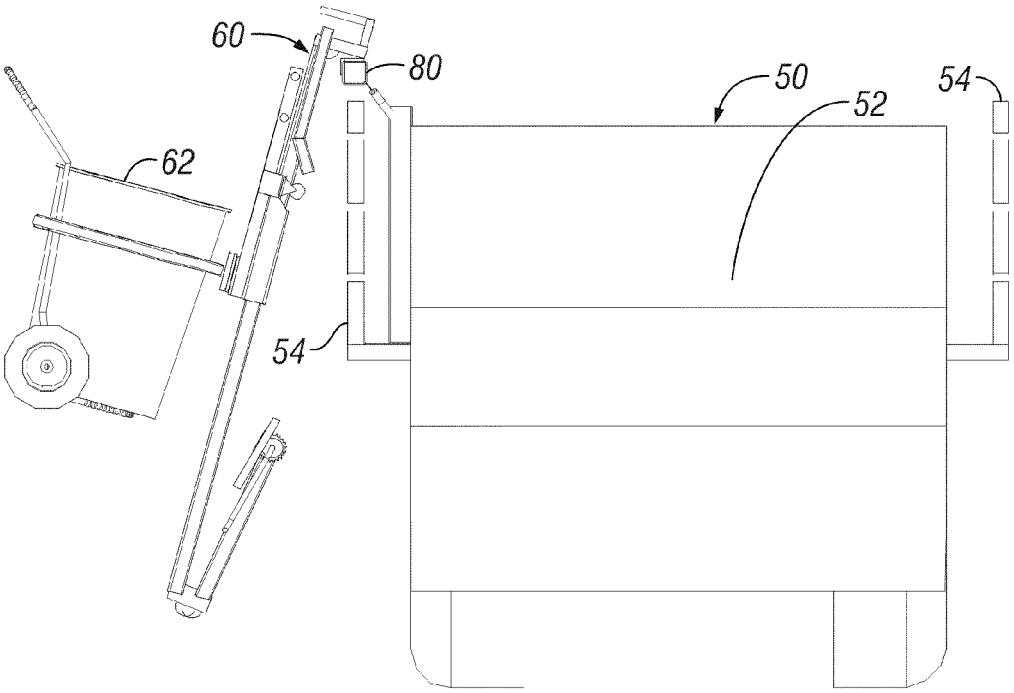
FIG. 9 illustrates the lift of FIG. 5-8 as the lift is lifting the container upwards and towards the truck.
Figure 10:
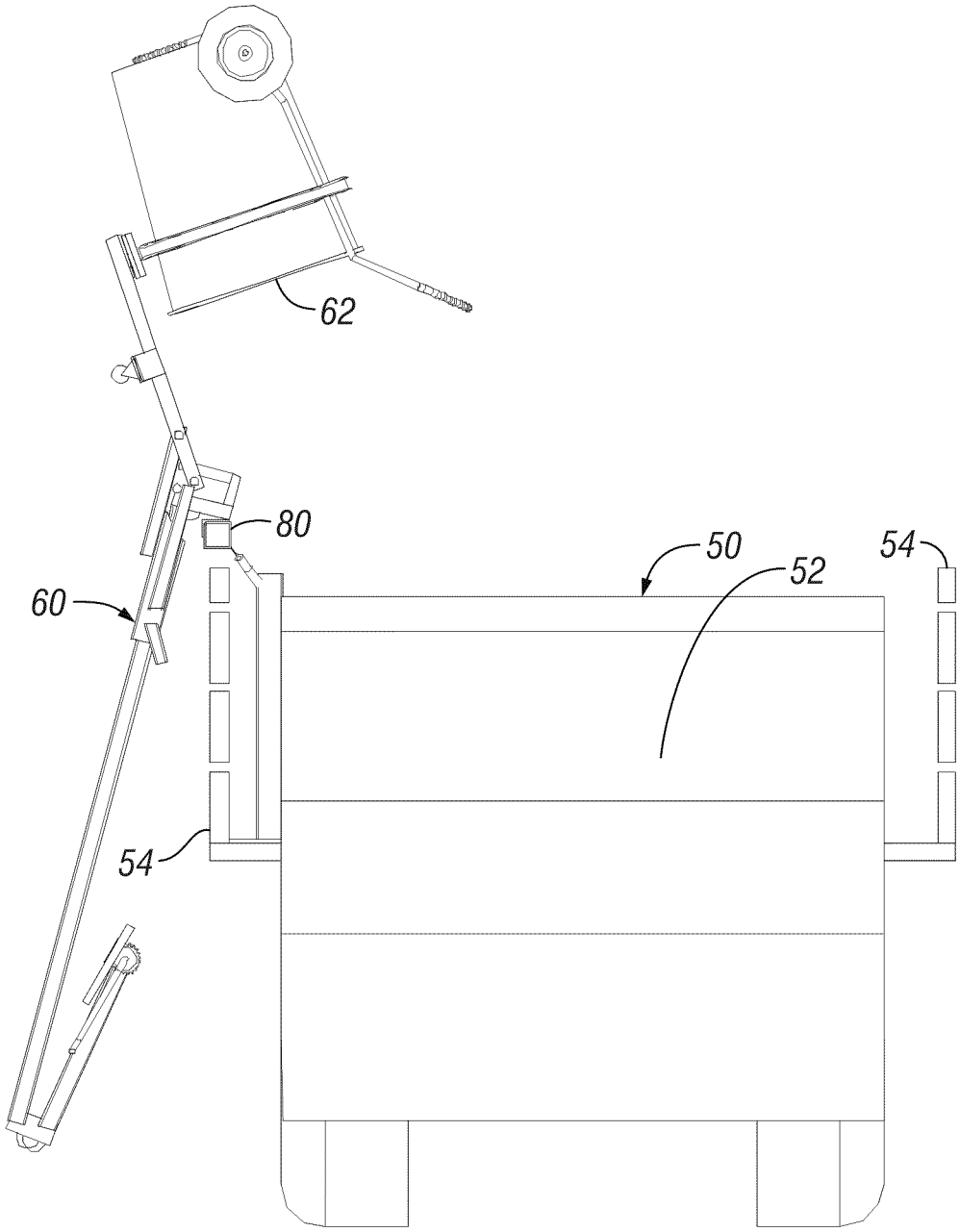
FIG. 10 illustrates the lift of FIG. 5-9 in a full dumping position with the container above the truck.

FIG. 7 illustrates the lift of FIG. 5-6 as the container is attached to the lift. FIG. 8 illustrates the lift of FIG. 5-7 as the lift begins to lift the container. FIG. 9 illustrates the lift of FIG. 5-8 as the lift is lifting the container upwards and towards the truck. FIG. 10 illustrates the lift of FIG. 5-9 in a full dumping position with the container above the truck.

Figure 11:
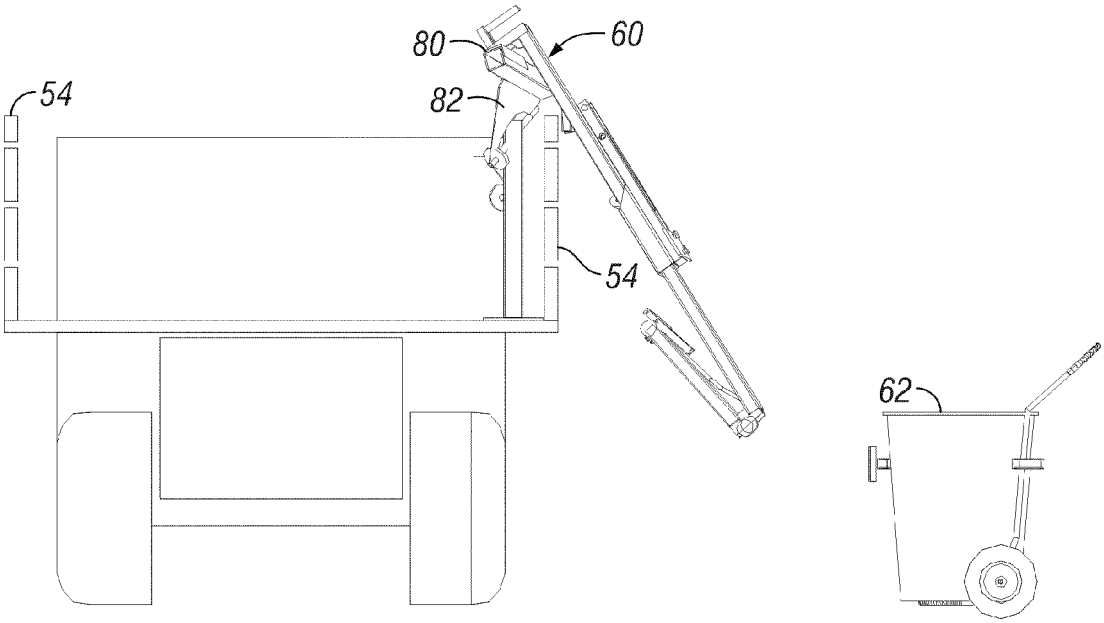
FIG. 11 illustrates the lift from a different angle and with the lift being moved towards a transport position.

FIG. 11 through FIG. 16 illustrates the lift moving towards or the lift in a transport position. The lift 60 has an arm 80 which is operatively connected to a single hinge 82. The hinge 82 is oriented at about an angle preferably in the range of 30 degrees to 60 degrees and most preferably about 45 degrees to the direction of travel. As the lift 60 is moved to a dumping position, the arm 80 rotates about the hinge 82. As illustrated in FIG. 11, the end of the arm 80 generally facing the rear of the truck will be raised at 30-60 degrees to the opposite end of the arm above horizontal. However, this range may be adjustable to ensure that the lift 60 clears any load in the truck. An actuator, either linear or rotary, may be used to rotate the arm 80 about the hinge 82 while the lift 60 is raised to move the lift to a transport position.

Figure 12:
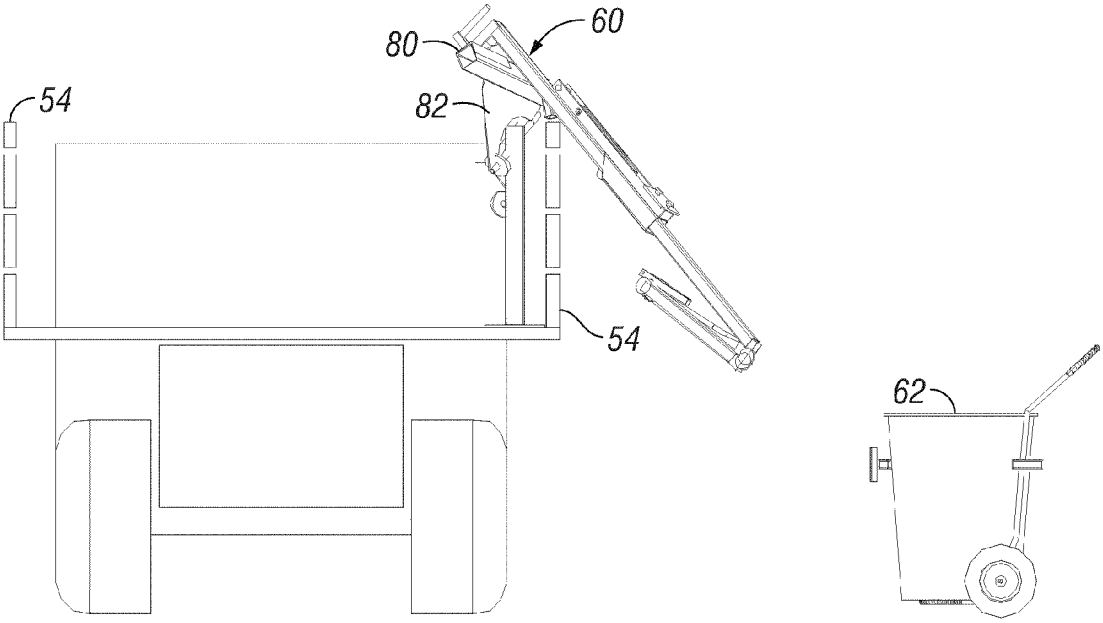
FIG. 12 illustrates the lift being moved further towards a transport position.
Figure 13:
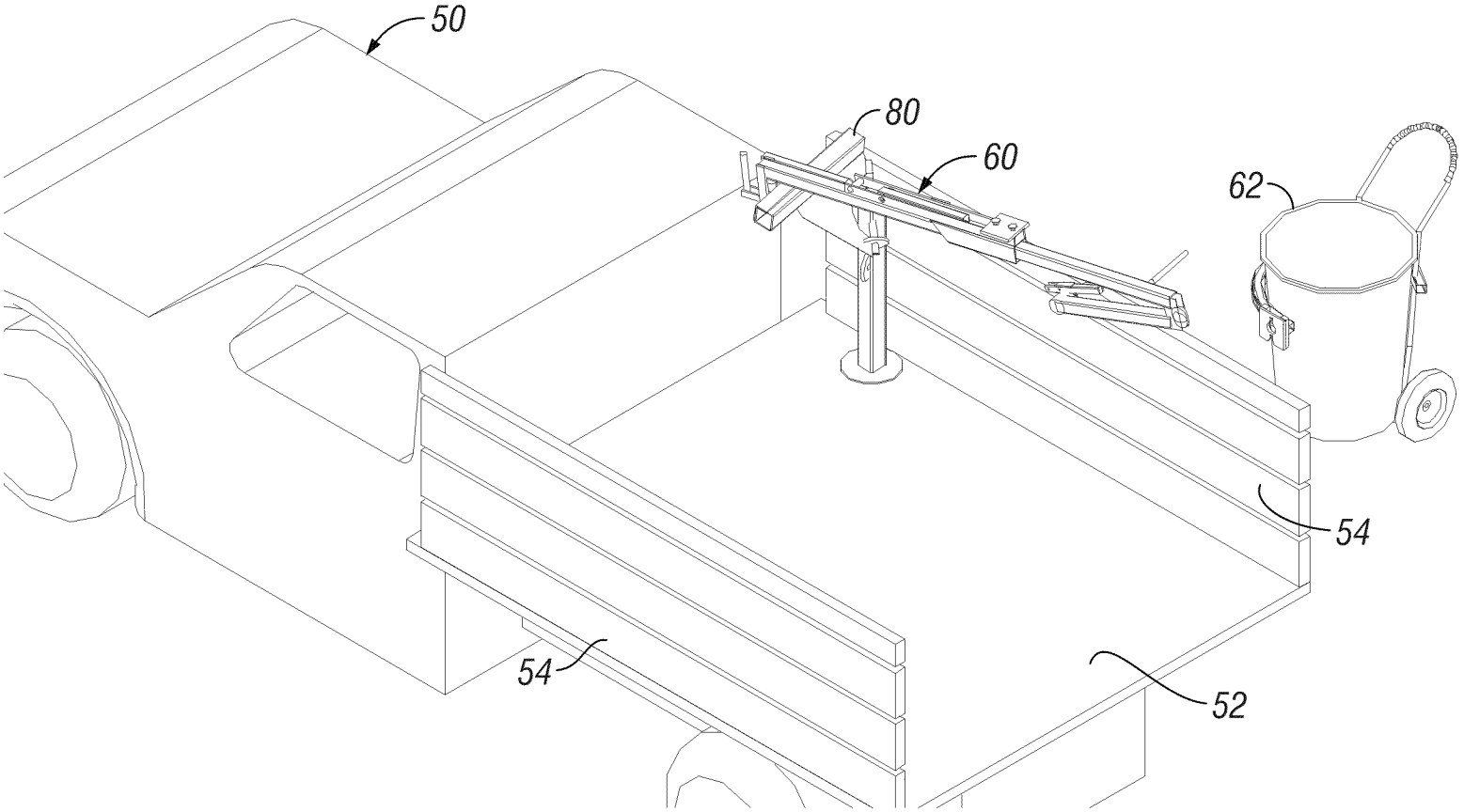
FIG. 13 is a perspective view showing the truck bed of the truck while the lift is being moved towards a transport position.
Figure 14:
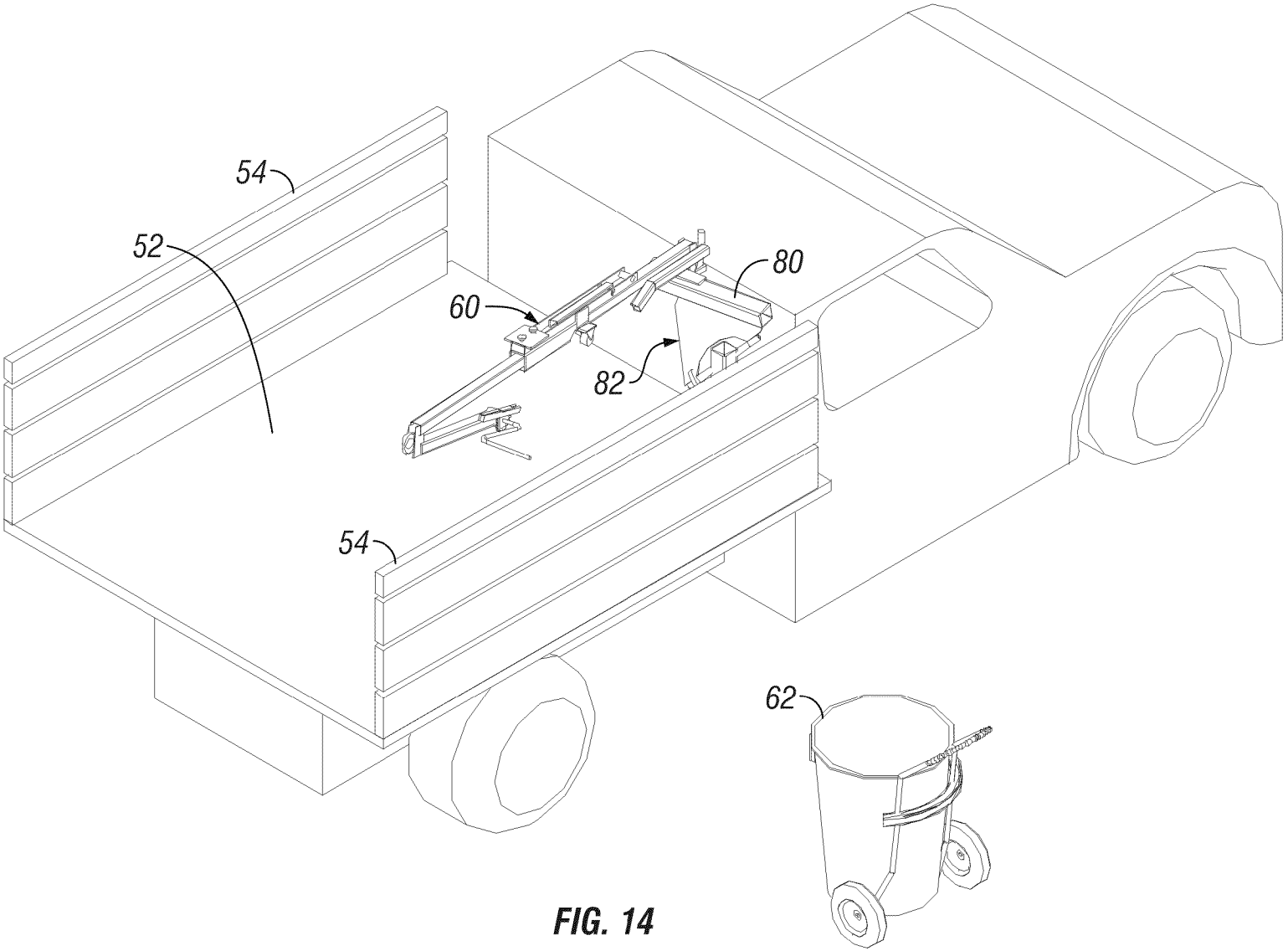
FIG. 14 is a perspective view showing the lift in a transport position.

FIG. 11 illustrates the lift 60 being moved towards a transport position. FIG. 12 illustrates the lift 60 being moved further towards a transport position. FIG. 13 is a perspective view showing the truck bed 52 of the truck 50 while the lift 60 is being moved towards a transport position. FIG. 14 is a perspective view showing the lift 60 in a transport position.

Figure 15:
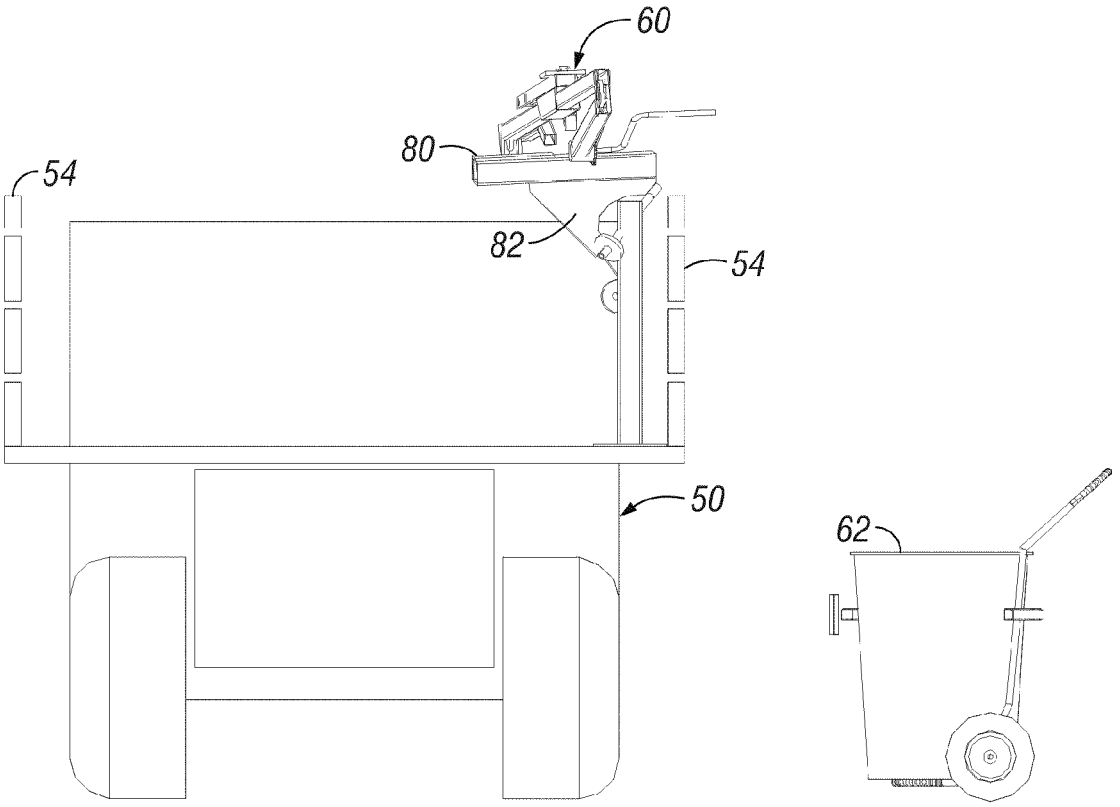
FIG. 15 illustrates the lift in a transport position.
Figure 16:
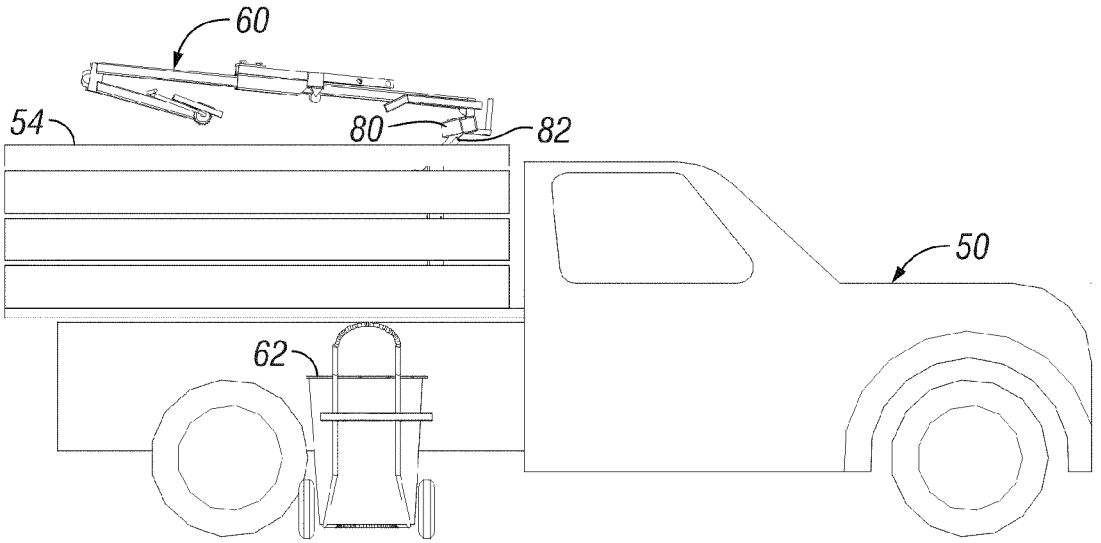
FIG. 16 illustrates the lift in a transport position.

FIG. 15 illustrates the lift 60 in a transport position. Note that the lift 60 is folded and is positioned along or proximate the side wall 54 of the truck 50, but above the truck 50. Note also that the lift 60 is above any load on the truck bed 52. Thus, the lift 60 when positioned in the transport position shown does not interfere with any load in the truck 50 and does not add to the transport width of the truck 50 during road travel. FIG. 16 illustrates a side view the lift 60 in a transport position illustrating the lift 60 in the same position as shown in FIG. 15.

Therefore a lift has been disclosed. It should be appreciated that the present invention contemplates numerous variations in the relative sizes and shapes of the structure, the types of machines to which the lift is mounted, and other variations, options, and alternatives. The present invention is not to be limited to the specific embodiments described herein.

What is claimed is:

1. A lift apparatus, comprising;

a bracket having a first member and a second member, the bracket being mounted on a structure;

an arm;

a main hinge operatively connected between the bracket and the arm;

an elongated spine connected to the arm;

a traveler operatively connected along the elongated spine for traveling up and down the elongated spine; and a first actuator connected along the elongated spine for traveling up and down the elongated spine;

a second actuator operatively coupled to the arm and configured to move the arm;

wherein movement of the arm rotates the arm about the main hinge allowing the arm to hinge rearwardly and upwardly;

wherein rotation of the arm about the main hinge moves the elongated spine and the traveler in an inclined plane between a generally vertical load position and a generally horizontal transport position.

2. The lift apparatus of claim 1 further comprising a dump portion attached to the traveler.

3. The lift apparatus of claim 2 wherein the dump portion comprises a dump container.

4. The lift apparatus of claim 1 wherein in the load position the traveler is positioned lower on the spine then in a dump position.

5. The lift apparatus of claim 4 wherein in the transport position the elongated spine is stored proximate to a sidewall of a vehicle.

6. The lift apparatus of claim 1 wherein the main hinge is oriented between 30 degrees and 60 degrees beyond vertical.

7. The lift apparatus of claim 1 wherein the main hinge is oriented at approximately 45 degrees beyond vertical.

8. The lift apparatus of claim 1 wherein the main hinge rotates the elongated spine and the traveler generally rearwardly and upwardly to move the elongated spine and the traveler to the transport position.

9. The lift apparatus of claim 1 further comprising:

a dump position comprising:

a) the elongated spine being substantially vertical;

b) the traveler being proximate to a top portion of the elongated spine;

c) wherein a cantilever hinge operatively connected to the elongated spine and the traveler permits rotation of the traveler relative to the elongated spine for emptying contents of a container.

10. A apparatus, comprising:

a spine oriented generally vertical in a load position;

a traveler operatively connected to the spine and configured to travel up and down the spin, the traveler oriented generally vertically in the load position;

a cantilevered hinge connected to the traveler, the cantilevered hinge permitting rotation of the traveler relative to the spine to an inclined dumping position;

an arm operatively connected to and generally perpendicular to the spine; and an angled arm hinge operatively connected to the arm to permit rotation of the arm generally rearwardly and upwardly to a transport position, wherein the spine and the traveler are generally horizontal in the transport position, wherein the arm is generally horizontal in the load position, the inclined dumping position, and the transport position.

11. The lift apparatus of claim 10 wherein the angled arm hinge is oriented at an angle from 30 degrees to 60 degrees from vertical.

12. The lift apparatus of claim 11 further comprising a dump container attached to the lift.

13. The lift apparatus of claim 12 wherein the spine, traveler and dump container are above the angled arm hinge in the transport position.

14. The lift apparatus of claim 10 wherein the angled arm hinge is configured to permit rotation of the arm between 30 degrees and 60 degrees above horizontal to the transport position.

15. The lift apparatus of claim 10 wherein the inclined dumping position is between 30 degrees and 60 degrees from vertical.

16. The lift apparatus of claim 10 wherein movement of the cantilevered hinge between the load position and inclined dumping position is imparted by an actuator causing movement of the traveler along the spine.

17. The lift apparatus of claim 10 wherein the arm in the load position is orthogonal to the arm in the transport position.

18. The lift apparatus of claim 10 wherein the spine is configured to act on the traveler to rotate the cantilevered hinge to the inclined dumping position.

* * * * *